United States Patent [19]

Pace

[11] Patent Number: 4,603,537

[45] Date of Patent: Aug. 5, 1986

[54] METHOD FOR MAKING A BAG WITH A BAG MOUTH CLOSURE

[75] Inventor: Vincent C. Pace, Bellevue, Wash.

[73] Assignee: Formost Packaging Machines, Inc., Woodinville, Wash.

[21] Appl. No.: 715,427

[22] Filed: Mar. 25, 1985

Related U.S. Application Data

[62] Division of Ser. No. 440,898, Nov. 12, 1982.

[51] Int. Cl.[4] ..... B65B 9/06; B65B 61/00

[52] U.S. Cl. ..... 53/415; 53/450; 53/482; 493/215; 493/927

[58] Field of Search ..... 383/89, 90; 53/415, 53/482, 450; 493/214, 215, 927

[56] References Cited

U.S. PATENT DOCUMENTS

| | | | |
|---|---|---|---|
| 220,510 | 10/1879 | Weaver | 383/89 |
| 2,260,064 | 10/1941 | Stokes | 53/415 |
| 3,353,662 | 11/1967 | Pickin | 383/90 |
| 3,504,475 | 4/1970 | Dickard | 383/89 |
| 3,553,933 | 1/1971 | Seko | 53/180 |
| 3,554,436 | 1/1971 | Palmer | 383/89 |
| 3,618,850 | 11/1971 | Palmer | 383/89 |
| 3,764,060 | 10/1973 | Ruda | 383/89 |
| 4,288,967 | 9/1981 | Seko et al. | 53/550 |
| 4,288,968 | 9/1981 | Seko et al. | 53/550 |

*Primary Examiner*—John Sipos

*Attorney, Agent, or Firm*—Robert W. Beach; Ward Brown

[57] ABSTRACT

In making a reclosable plastic film bag, bag mouth lips are formed projecting beyond a heat-seal band closing the bag mouth and a stiffening patch is bonded to the interior or exterior of a bag mouth lip between the heat-sealing band and the bag mouth end. The stiffening patches for the reclosable bag mouth end can be applied to a strip of sheet material for making bags at the time that the bags are formed and filled by clipping from a strip of patch-making material patch pieces having pressure-sensitive adhesive on one side. Such patch pieces are transferred from a clipper onto the bag-making material by a revolving transfer member having a suction pick-up to pick up a patch piece and a blow subsequently detaches the patch piece from the transfer member and deposits it onto the strip of bag-making material.

3 Claims, 12 Drawing Figures

Fig. 8
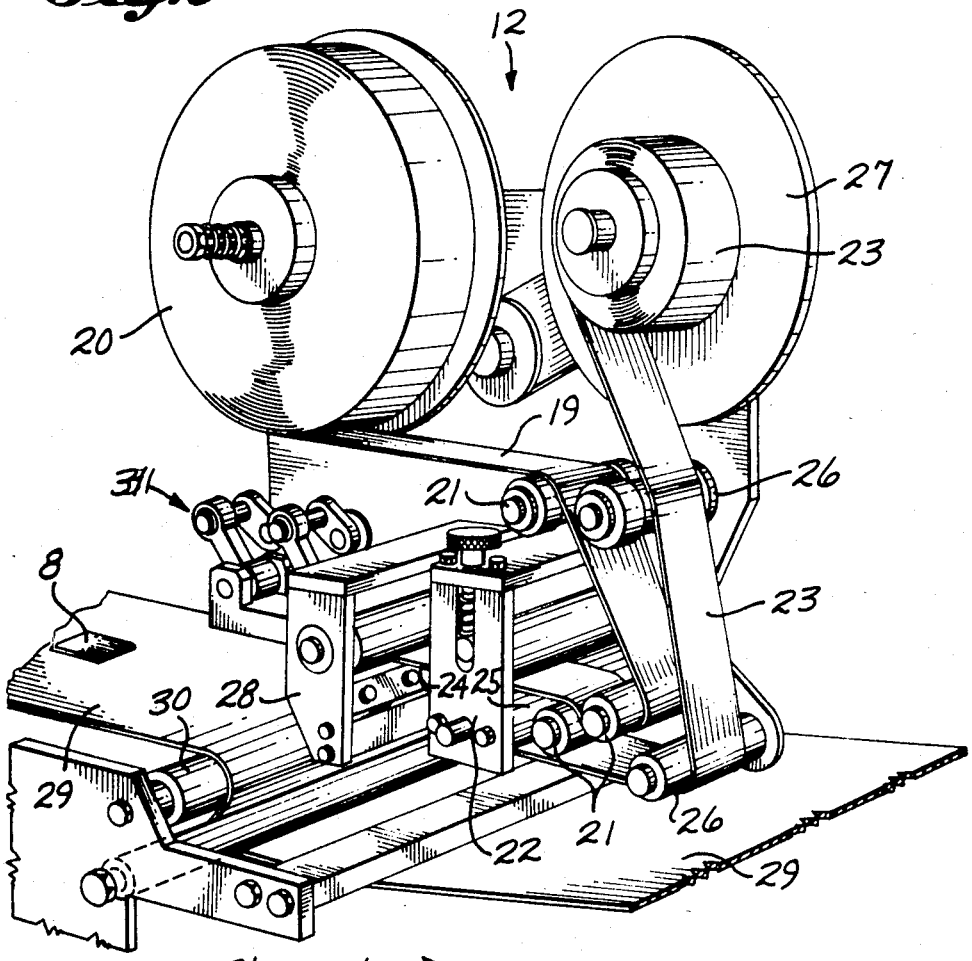
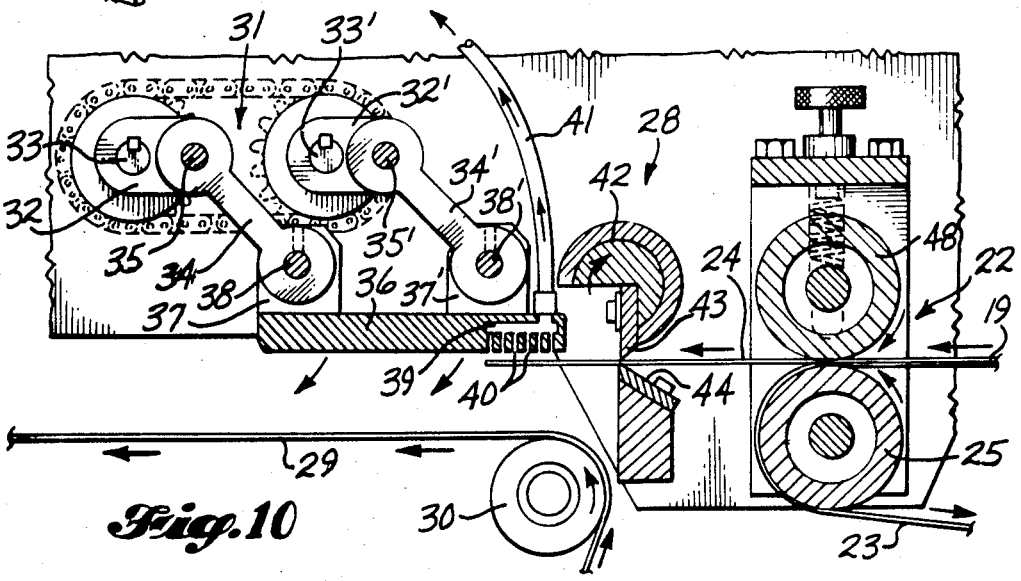
Fig. 10

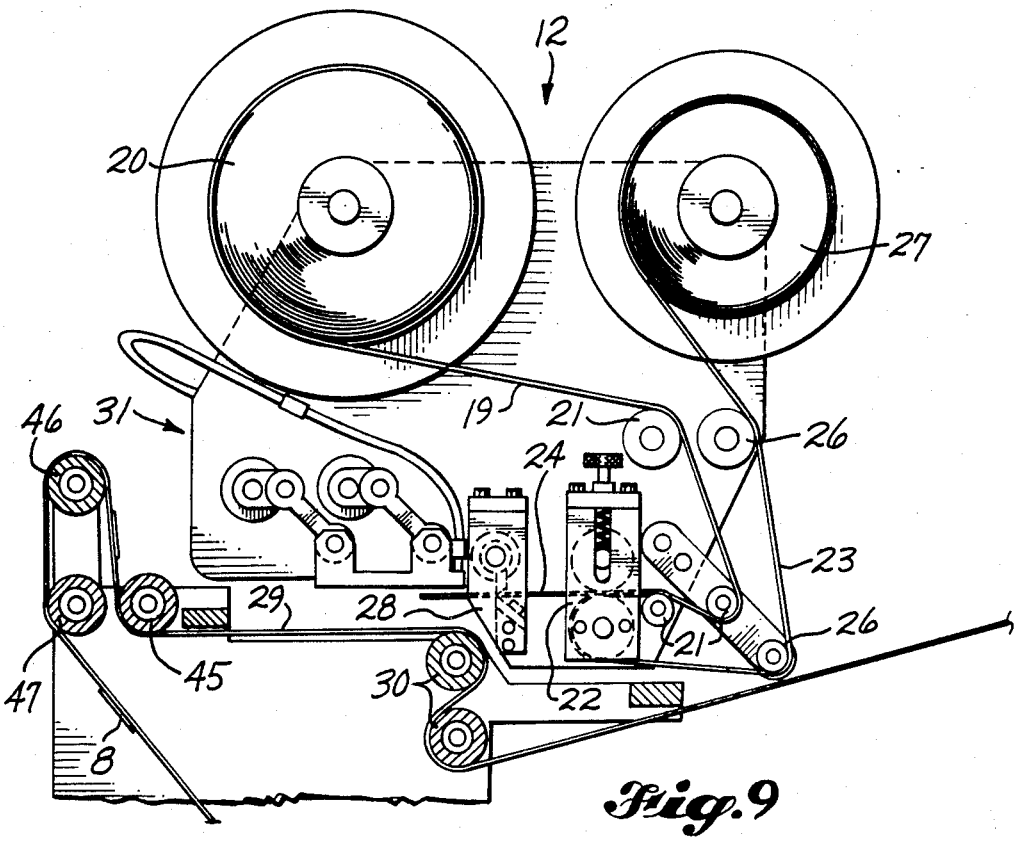
Fig. 9
Fig. 11
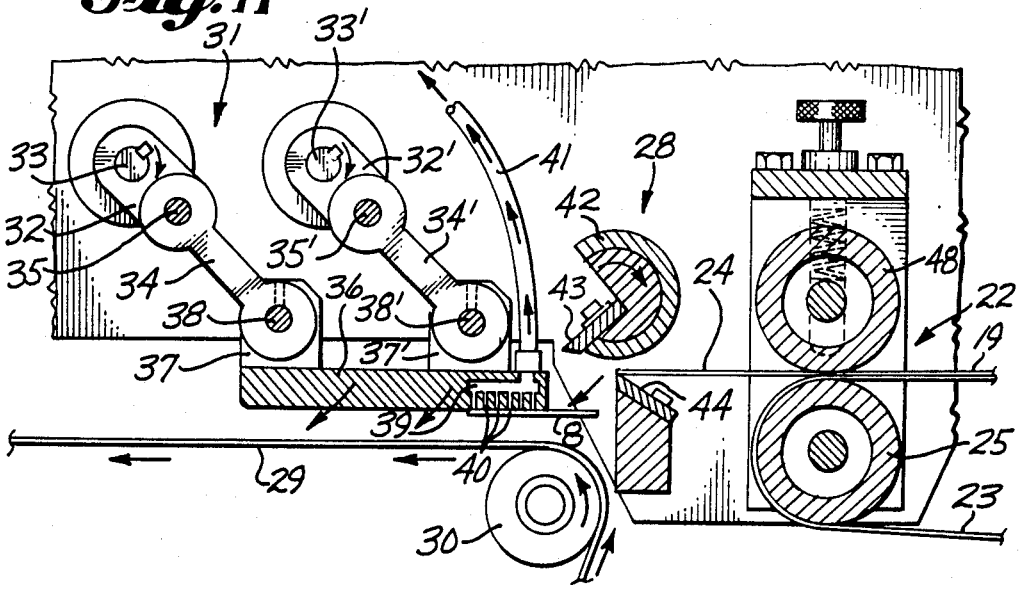

METHOD FOR MAKING A BAG WITH A BAG MOUTH CLOSURE

CROSS REFERENCE

This application is a division of my copending application Ser. No. 440,898, filed Nov. 12, 1982, for Bag Mouth Closure and Method and Apparatus for Making the Same.

BACKGROUND OF THE INVENTION

1. Field of the Invention

This invention relates to a method for making a bag of heat-sealable plastic film which is contructed to be heat-sealed initially and has a bag mouth closure for reclosing the bag securely after an initial seal has been parted.

2. Prior Art

Methods for making heat-sealable bags of plastic film heat-sealable material are shown in U.S. Pat. Nos. 3,553,933 issued Jan. 12, 1971; 4,288,967 issued Sept. 15, 1981; and 4,288,968 issued Sept. 15, 1981. Such patents, however, do not show a method for making the reclosable closure.

SUMMARY OF THE INVENTION

A principal object of the present invention is to provide a method for making bags of heat-sealable plastic film having a reliable closure for the mouths of such bags which can be used to reclose the bags after they have been opened and even a small amount of the bag contents removed. Such closure structure can be manufactured readily during a bag-forming, bag-filling and bag-closure process.

The forgoing objects can be accomplished by utilizing a method for making a heat-sealable bag of plastic material and applying the stiffening patch to the bag-making material in proper position during the bag-forming operation.

BRIEF DESCRIPTION OF THE DRAWINGS

FIG. 8 is a top perspective of the portion of the apparatus for applying a stiffening patch to bag-forming material, parts being broken away.

FIG. 9 is a side elevation of the component of the bag-making apparatus for applying a stiffening patch to the bag-making material with parts shown in section.

FIGS. 10, 11 and 12 are enlarged side elevations of a portion of the component of apparatus for applying a stiffening patch to bag-making material having parts broken away and showing parts in different operative positions.

DETAILED DESCRIPTION

Figure 1:
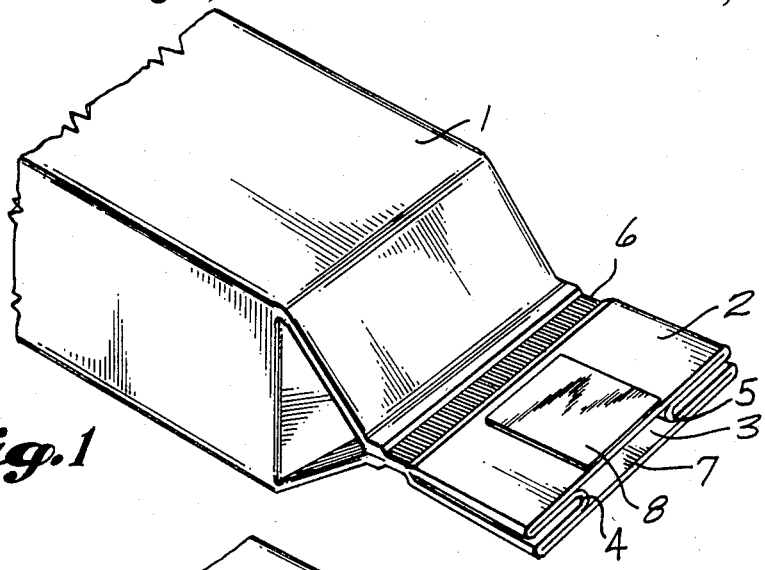
FIGS. 1, 2, and 3 are top perspectives of the mouth end portion of a bag showing a bag closure made by the method of the present invention, part of the bag body being broken away in each instance.

The bag 1 can be made of flexible packaging sheet material, preferably heat-sealable polypropylene or polyethylene plastic material which is customarily used for packaging products of various types, but is particularly used for packaging food products such, for example, as cookies or candy. Customarily, only a portion, and sometimes only a very small portion, of the contents of a bag is removed when the bag is first opened, and it is often considered to be desirable to empty the entire contents of the bag into a jar or can or some other permanent type of container because the bag mouth cannot be reliably reclosed. It is important not only to provide a reliable bag mouth reclosure structure, but also one which can be made automatically in the bag-making process.

The mouth of the plastic film bag shown in FIGS. 1, 2, 3 and 5 is formed by extended parallel planar principal lips 2 and 3, the opposite edges of which are joined by infolded sides 4 and 5. The heat-sealed band 6 bonding together the opposite projecting lips 2 and 3 is spaced from the end 7 of the bag mouth a distance sufficient to accommodate between such heat-sealed band and the end of the bag mouth a stiffener 8 of sufficient extent lengthwise of the bag to be folded in at least two return bends, as shown in FIG. 4. The thicknesses of the bag material and of the stiffener are exaggerated in FIG. 4 for clarity of illustration.

The stiffener 8, shown in FIGS. 1 to 4 as being bonded to the exterior of bag lip 2, is a patch of material, preferably metal, which is deformable and substantially nonresilient so that when bent manually, or subsequently unbent, it will hold its bent shape or unbent shape, respectively. The patch is made of a sufficient width transversely of the bag, of a sufficient thickness and of material sufficiently malleable, but sufficiently resistant to deformation, so that the projecting bag mouth can be bent or rolled from the condition of FIG. 1 to the condition of FIGS. 3 and 4 and will reliably retain such bent or rolled condition. At the same time, however, the size, thickness and characteristics of the patch should be such that the bag mouth can easily be unfolded or unrolled again to the condition of FIG. 1 to enable the bag mouth to be opened even though creases may persist in the stiffener. Moreover, the material of the patch should be sufficiently resistant to fatigue that the bag mouth can be folded or rolled and subsequently unfolded or unrolled repeatedly without the stiffener breaking or cracking.

To provide a stiffener having such characteristics, it should be of substantial width transversely of the bag from at least about one-third of the transverse width of the major bag lips 2 and 3, and preferable 2 or 3 inches (5 to 8 cm) in width. The thickness of the stiffener should be a few thousandths of an inch, preferably in the range of 0.001 to 0.004 of an inch (0.025 to 0.1 of a mm), the preferred thickness being 0.003 of an inch (0.075 of a mm). A material having suitable physical characteristics is substantially pure aluminum such as the aluminum alloy designated 11450.

The heat seal 6 is of a character such that its components on the major lips 2 and 3 of the bag mouth can be parted rather easily without rupturing the bag material by simply pulling the lips 2 and 3 apart. For this purpose, the heat-sealing temperature is within the range of 350° F. to 450° F. (177° to 250° C.) and not exceeding 550° F.(330° C.).

Bags of heat-sealable plastic film frequently have their heat-seal bands so close to the bag mouth end 7 that it is difficult to grip the portions of the lips which are sealed that project beyond the heat-seal band. Also, such heat seals are frequently so tight that it is difficult if not impossible to part the heat-seal components without rupturing the bag material. Under such circumstances it is often necessary to puncture the bag material at the side of the heat-seal band remote from the bag mouth end so that the bag cannot be reclosed. Even if reclosure means were provided at the side of the heat-seal band remote from the bag mouth end, such reclosure means could not be used effectively unless a substantial amount of the bag contents were first removed.

In the bag closure made by the process of the present invention, one edge of the stiffener 8 is preferably located substantially flush with the bag mouth end 7. The extent of the stiffener lengthwise of the bag should be sufficient to enable the double return bend shown in FIGS. 3 and 4 to be formed with the stiffener extending around the outer periphery of the bend. By utilizing a stiffening patch of such extent lengthwise of the bag, the projection of the bag lips 2 and 3 beyond the heat-seal band 6 will be sufficient to enable a secure grip of the lips 2 and 3 to be exerted manually so that a firm separating pull can be exerted on the projecting lips to part the components of the heat seal 6 and open the bag mouth from the condition shown in FIG. 1 to that of FIG. 2. Whether or not any contents of the bag is removed, the bag mouth can be reclosed securely to the condition of FIGS. 3 and 4 by folding or rolling the bag lips 2 and 3 and the stiffener 8 in at least two return bends.

Figure 2:
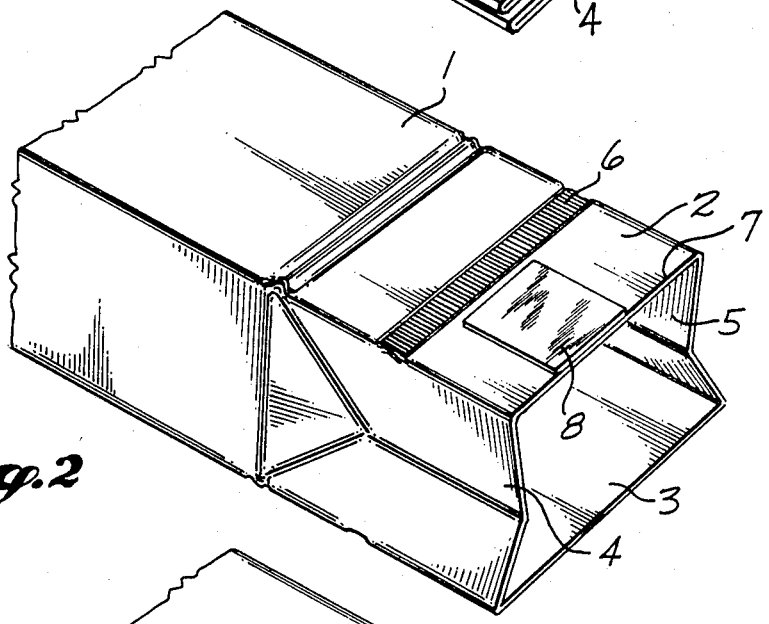
Figure 3:
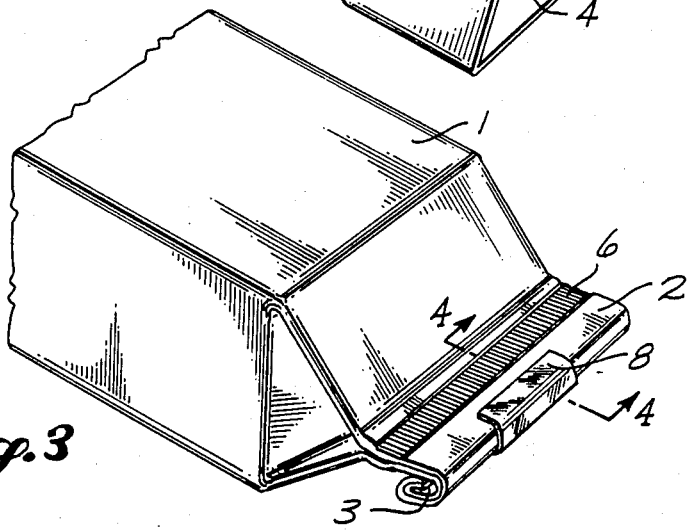
Figure 5:
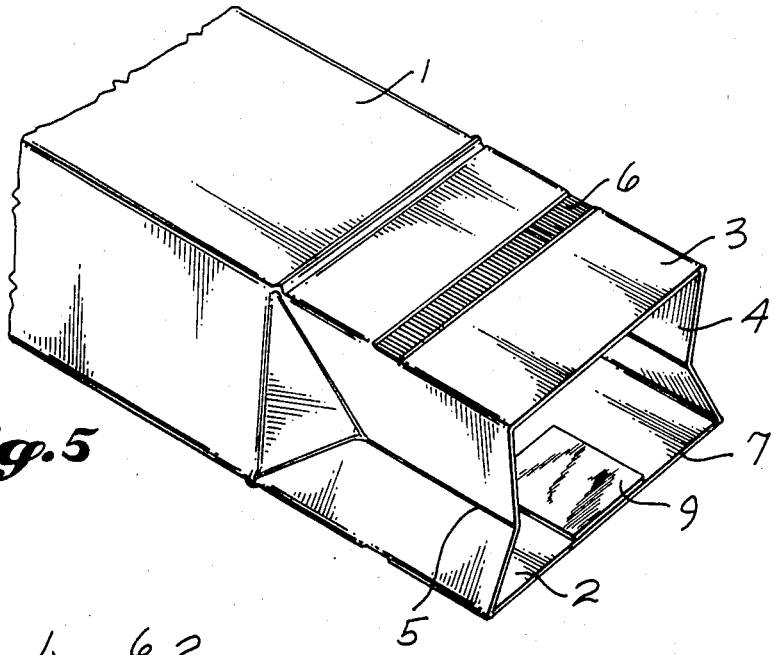
FIG. 5 is a top perspective of the mouth end of a bag corresponding to FIGS. 1, 2 and 3 but showing an alternative type of bag mouth closure.
Figure 4:
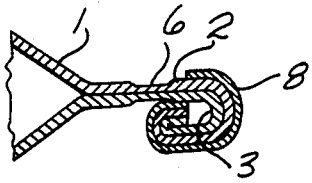
FIG. 4 is a detailed transverse section through the bag closure, the bag body being broken away.

In FIGS. 1, 2 and 3 the stiffener 8 is shown as being bonded, such as by pressure-sensitive adhesive, to the exterior of the lip 2. In FIG. 5, the stiffener 9 is shown as being bonded to the inner face of the lip 2 instead of to its outer face, again with one edge being substantially flush with the bag mouth end 7. The patch 9 of FIG. 5 preferably is of approximately the same size, shape and material as the patch 8 shown in FIGS. 1, 2 and 3. Also, the location of the patch of FIG. 5 will be approximately the same as the location of the patch shown in FIGS. 1, 2 and 3 except for being bonded to the inside of the bag lip 2 instead of to the outside of such lip. Also, the heat seal 6 in the bag of FIG. 5 will be spaced from the bag mouth end 7 substantially the same distance as the spacing between the heat seal 6 and the bag mouth end in the closure of FIGS. 1, 2 and 3.

Figure 6:
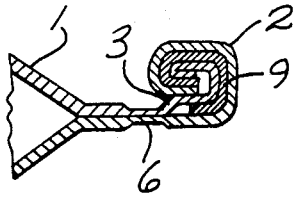
FIG. 6 is a detailed transverse section through the closure portion of the bag corresponding to FIG. 4 but showing the bag closure structure of FIG. 5.

When the bag mouth is closed by the heat seal 6, the lips 2 and 3 will be held sufficiently close together as to substantially conceal the stiffener 9. After the bag has been opened, however, such stiffener will enable the bag mouth to be reclosed by folding or rolling the principal bag lips 2 and 3 with the stiffener between them in the manner shown in FIG. 6. In this instance, the stiffener will effect a reliable closure of the bag mouth even though it is on the inside of the lip 2, as shown in FIG. 6, because it is bonded to such lip and is positioned exteriorly of the opposite lip 3 which is on the inner side of the fold or roll.

Figure 7:
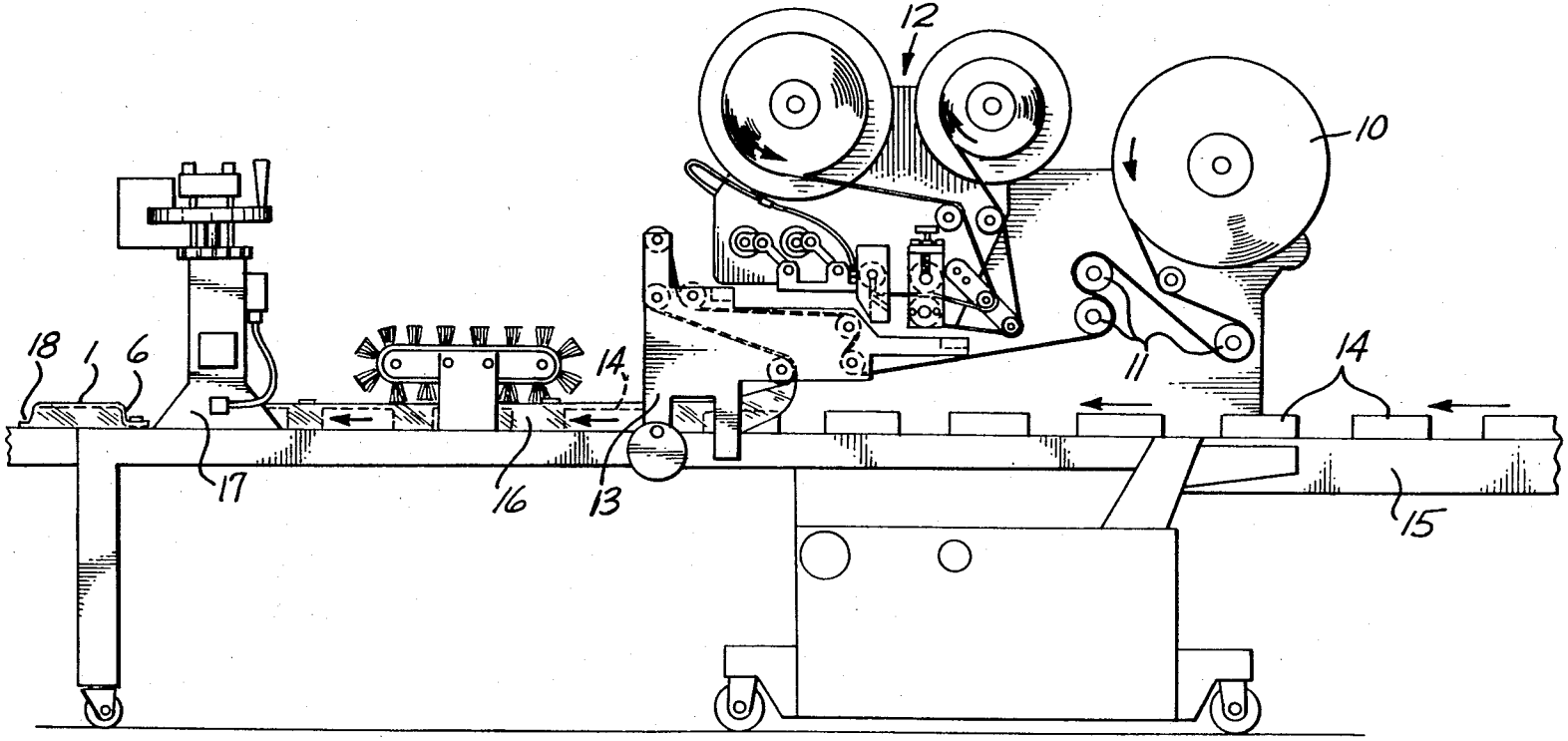
FIG. 7 is a side elevation of apparatus for making and filling bags according to the present invention shown somewhat diagrammatically and with parts broken away.

Apparatus for performing the step of applying the patch 8 of FIGS. 1, 2 and 3, or the patch 9 of FIG. 2, to bag-making material during the bag-making process is shown in FIGS. 7 to 12. FIG. 7 shows the overall apparatus for performing the bag-forming and filling process, while FIGS. 8 to 12 show in greater detail apparatus for performing the patch-applying step. In general, the bag-making heat-sealable plastic film is supplied in a roll 10 from which sheet is dispensed as necessary around guide and smoothing rolls 11. The bag-making sheet material then passes through the component 12 for applying the stiffening patch 8 or 9 onto the bag tube-forming component 13. Product 14 to be bagged is transported by conveyor 15 to the tube-forming station 13 and a longitudinal seam of the bag is completed at station 16. From there the bag is moved to the heat-sealing and tube-severing station 17 shown at the left of FIG. 7 where a strong heat seal 18 is made to seal the bottom of the bag 1, a comparatively weak heat seal 6 is provided to seal the mouth of the bag, as described in connection with FIGS. 1 to 6 and the bags are separated by severing the tube between each stiffening patch and the adjacent strong heat seal 18.

The stiffening patches 8 or 9 are applied to the bag-making material by the component 12 of the apparatus as shown in greater detail in FIGS. 9 to 12, inclusive. The patches are cut from a continuous composite strip 19 of material supplied from a roll 20 of such material. Such composite strip includes a strip of aluminum foil having pressure-sensitive adhesive on one side, which side is covered by a protective backing strip or liner. From the supply roll 20, the composite strip passes around guide rollers 21 to the liner stripper 22. Such stripper strips the lining strip 23 from the patch-making strip 24 and the liner passes around the stripping roll 25 and guide rollers 26 to be wound on take-up spool 27.

The patch-making strip proceeds to the shear 28 which cuts patches to length for transfer to the bag-making sheet material 29 which is guided to the patch-applying station by a guide roller 30.

The patch transfer mechanism 31, shown best in FIGS. 9 to 12, includes twin cranks 32 and 32' rotatively mounted on spaced parallel crankshafts 33 and 33'. Such cranks carry parallel arms 34 and 34', respectively, corresponding ends of which are journaled on the respective crank ends 35 and 35' of the crank arms 32 and 32'.

A spreader bar 36 has posts 37 and 37' upstanding from its opposite ends that are fixed to pins 38 and 38' integral with and projecting from corresponding ends of the parallel arms 34 and 34', respectively, by set-screws. Consequently, as the crank arms 32 and 32' rotate clockwise from their positions of FIG. 10 through their positions of FIG. 11 to their positions of FIG. 12, the spreader 36 will revolve while maintaining an attitude always parallel to the plane of the sheet-forming film 29 beneath it.

One end of the spreader 36 has in it a chamber 39 with which the inner ends of small air passages 40 communicate. An air hose 41 is connected to such spreader and is in communication with its chamber 39.

The shear 28 includes a rotor 42 carrying a rotating blade 43 which cooperates with the stationary anvil 44 to clip successive patches 8 from the strip 24 of patch-making material. The rotation of the rotor 42 is coordinated with the rotation of the crankshafts 33 and 33' so each patch 8 is cut from the patch-making strip 24 at a predetermined time.

Figure 12:
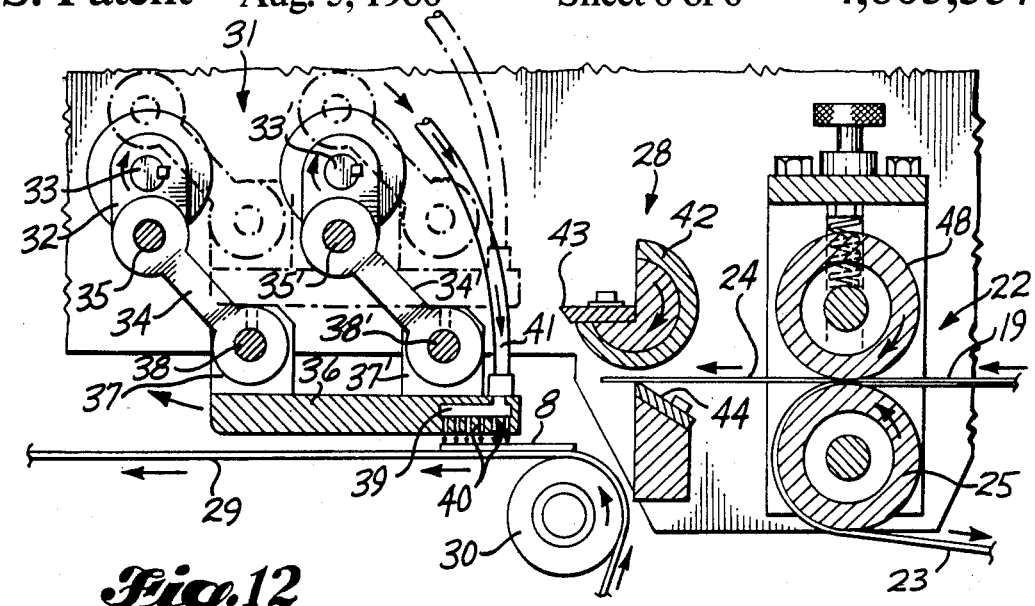

When the spreader 36 is in the position of FIG. 10, air will be withdrawn through the hose 41 so that suction will occur beneath the spreader 36 in the vicinity of the apertures 40. As the spreader descends from the position shown in FIG. 10, its suction end will engage and grip the projecting end of the strip 24 at just the instant that blade 43 clips off such projecting end portion to form a patch. Such severed patch will be gripped by the suction of the spreader 36 so that the spreader carries the patch downward into a position in proximity to the bag-making sheet 29, as shown in FIG. 12. In that position of the spreader, the suction applied to hose 41 is discontinued and through that hose air is supplied to the spreader chamber 39 and the apertures 40 to blow the patch 8 down onto the bag-making sheet 29. The patch will be stuck to the sheet 29 more or less tightly by the pressure-sensitive adhesive.

From the patch-applying station 31, the bag-making material 29 is moved beneath roller 45 shown in FIG. 9 and then around upper roller 46 and lower roller 47 to the bag-forming station 13 shown in FIG. 7. Passage of the patch 8 in contact with the roller 45 will iron the patch onto the sheet to set the pressure-sensitive adhesive so that the patch will be bonded firmly to the sheet.

The stripping roller 45, its cooperating pressure roller 48, the shear 28, the crank shafts 33 and 33', the product supply conveyor 15, the tube-forming mechanism 13 and 16 and the heat-sealer 17 are coordinated in their operation so that the patch 8 will be cut off and applied to the bag-making sheet at the proper time for it to be positioned accurately on the completed bag in the position discussed in connection with FIGS. 1, 3 and 5.

I claim:

1. The process of making reclosable bags which comprises moving bag-making sheet material lengthwise, adhesively applying to such bag-making sheet material stiffening patches at predetermined intervals lengthwise of the direction of movement of the bag-making sheet material, forming the bag-making sheet material into a tube, inserting into the tube between the stiffening patches product to be packaged, sealing the tube at both sides of each patch to form spaced seals with each seal located adjacent to a stiffening patch and between such patch and adjacent product received in the tube, severing the tube along a cutting line between a seal and an adjacent stiffening patch carried by the bag material to form two adjacent ends of two adjacent bags with the seal adjacent to such cutting line entirely on the adjacent end of a first bag and the adjacent stiffening patch carried entirely by the adjacent end of a second bag, thereby enabling subsequent parting of the parts of the seal of the second bag between the stiffening patch carried thereby and the product in such second bag and thereby opening the second bag to afford access to the product therein through the bag end carrying the stiffening patch and enabling manual bending of the stiffening patch carried by such bag end and the sheet material to which such stiffening patch is applied about a straight line parallel to the ends of the second bag for reclosing the end of the second bag carrying the stiffening patch.

2. The process defined in claim 1, in which one of the seals located adjacent to each stiffening patch is stronger than the other seal located adjacent to such stiffening patch, and each tube cutting line is located between a stiffening patch and the stronger seal adjacent to such patch for separating the tube into individual bags with each weaker seal located between the patch carried by such bag and the product in such bag.

3. The process of making reclosable bags which comprises moving bag-making sheet material lengthwise, adhesively applying to such bag-making sheet material stiffening patches at predetermined intervals lengthwise of the direction of movement of the bag-making sheet material, forming the bag-making sheet material into a tube, inserting into the tube between the stiffening patches product to be packaged, sealing the tube at both sides of each patch to form spaced seals with each seal located adjacent to a stiffening patch and between such stiffening patch and adjacent product received in the tube, severing the tube along a cutting line between a seal and an adjacent stiffening patch carried by the bag material to form two adjacent ends of two adjacent bags with the seal adjacent to such cutting line entirely on the adjacent end of a first bag and the adjacent stiffening patch carried entirely by the adjacent end of a second bag, subsequently parting the parts of the seal of the second bag between the stiffening patch carried thereby and the product in such second bag and thereby opening the second bag to afford access to the product therein through the bag end carrying the stiffening patch, and manually bending the stiffening patch carried by such bag end and the sheet material to which such stiffening patch is aplied about a straight line parallel to the ends of the second bag for reclosing the end of the second bag carrying the stiffening patch.

* * * * *